US005513393A

United States Patent [19]

Ferreira et al.

[11] Patent Number: 5,513,393

[45] Date of Patent: May 7, 1996

[54] FORM-ENHANCING DEVICE

[76] Inventors: Robert Ferreira; Juan F. Batista, both of 35-24 90 St., Jackson Heights, N.Y. 11372

[21] Appl. No.: 322,202

[22] Filed: Oct. 13, 1994

[51] Int. Cl.[6] ..... A41D 27/26; A41C 3/14

[52] U.S. Cl. ..... 2/267; 2/46; 2/400; 450/97; 450/99

[58] Field of Search ..... 2/2.5, 46, 73, 267, 2/400, 401, 402, 403, 406, 408, 79, 227, 67, 1, 2; 450/1, 30, 31, 32, 53, 54, 55, 56, 57, 94, 97, 98, 99, 114, 132, 156; 604/385.1, 385.2, 386, 396

[56] References Cited

U.S. PATENT DOCUMENTS

| | | | |
|---|---|---|---|
| D.270,489 | 9/1983 | Camus . | |
| 2,332,141 | 10/1943 | Greene | 2/267 |
| 2,565,866 | 8/1951 | Loftus et al. | 450/99 |
| 2,668,953 | 2/1954 | Tofanelli | 2/408 X |
| 2,752,602 | 7/1956 | Wilhelm | 2/267 |
| 2,807,805 | 10/1957 | Allan | 450/98 X |
| 3,131,698 | 5/1964 | Morano | 450/99 |
| 3,295,530 | 1/1967 | Mayer et al. | 450/98 |
| 3,620,222 | 11/1971 | Block | 450/57 |
| 3,909,847 | 10/1975 | Holt et al. | 2/401 X |
| 4,969,216 | 11/1990 | Guelli . | |
| 4,984,304 | 1/1991 | Brown . | |
| 5,103,505 | 4/1992 | Liorens | 450/98 X |
| 5,157,789 | 10/1992 | Klass | 2/114 |

FOREIGN PATENT DOCUMENTS

| | | | |
|---|---|---|---|
| 181261 | 8/1976 | WIPO | 2/267 |

*Primary Examiner*—Jeanette E. Chapman
*Attorney, Agent, or Firm*—Collard & Roe

[57] ABSTRACT

A soft polygonal pad secured adjacent a rear side of an undergarment adapted to enhance one's figure. The pad includes a pair of protruding hemispherical regions adjacent a lower edge of the pad.

9 Claims, 2 Drawing Sheets

FORM-ENHANCING DEVICE

BACKGROUND OF THE INVENTION

1. Field of the Invention

The present invention relates to form-enhancing device. More particularly, it relates to a form-enhancing undergarment which has a form-shaping pad incorporated therein.

2. The Prior Art

Undergarment such as girdles or panty girdles are known which provide body-confining and molding action. However, the prior art does not include undergarments which are designed to expand and shape the wearer.

SUMMARY OF THE INVENTION

It is therefore an object of the present invention to provide a form-enhancing device which expands and shapes the existing contour of the wearer.

It is a further object of the present invention to provide a form-enhancing undergarment which has a form-shaping pad incorporated therein.

These and other related objects are achieved according to the invention by a form-enhancing undergarment including a front portion having two spaced opposite side margins and a back portion having two corresponding spaced opposite side margins. The back portion consists of a pair of overlapping back sections that form a pouch therebetween. A crotch section is joined between the front portion and the back portion. A form-shaping pad is disposed within the pouch and extends between, and is secured at the side margins of the back portion. The front portion, the back portion and the crotch section have complimentary lower margins forming leg apertures. The form-shaping pad extends along, and is secured at the back portion lower margins. The back portion includes a lower edge, along which it is joined with the crotch section. The form-shaping pad extends along and is secured at the lower edge.

The pair of overlapping back sections include an interior back section and an exterior back section. The exterior back section includes two fabric panels joined by a contour producing seam. The front and back portions each include an upper edge defining a waist opening. The form-shaping pad extends along and is secured at the back portion's upper edge.

The form-shaping pad includes a flat upper region adjacent the back portion's upper edge, a curvaceous lower region adjacent the back portion's lower edge and a transition region extending between the flat upper region and the curvaceous lower region. The form-shaping pad includes a flat side region adjacent each of the back portion side margins. The form-shaping pad includes a flat lower region adjacent part of the back portion's lower margins near the back portion side margins. The curvaceous lower region is adjacent the remainder of the back portion's lower margins near the back portion's lower edge. The form-shaping pad is made of a soft flexible material, for example, foam rubber.

Alternatively, the invention consists of a device secured adjacent a rear side of an undergarment adapted to enhance one's figure. The device comprises a soft polygonal planar pad, having an upper edge and a spaced opposite lower edge. A flat upper region is adjacent the upper edge and has a first thickness. A pair of hemispherical lower regions are adjacent the lower edge. The lower regions have a second thickness, at least three times thicker than the first thickness. A transition region is located between the flat upper regions and the hemispherical lower regions and has a thickness that varies from a first thickness to a second thickness. The soft polygonal pad has an interior surface and an exterior surface. The hemispherical lower regions protrude from the exterior surface and the interior surface includes a pair of depressions corresponding to and opposite of the hemispherical lower regions. The soft polygonal planar pad includes a V-shaped space between the pair of hemispherical lower regions and a central strip bordering the space. The central strip has a thickness slightly greater than the first thickness. The soft polygonal planar pad is made from foam rubber.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
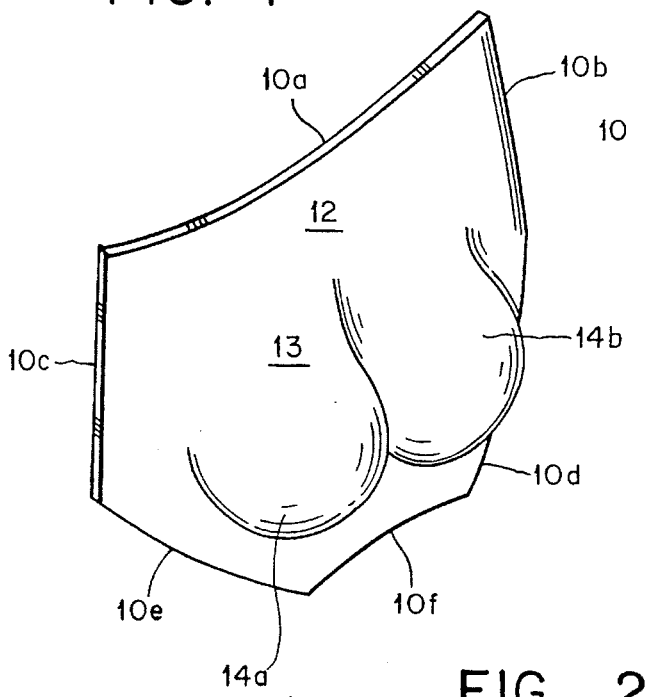
FIG. 1 is a rear, top, left side perspective view of a form-shaping pad according to the invention.
Figure 2:
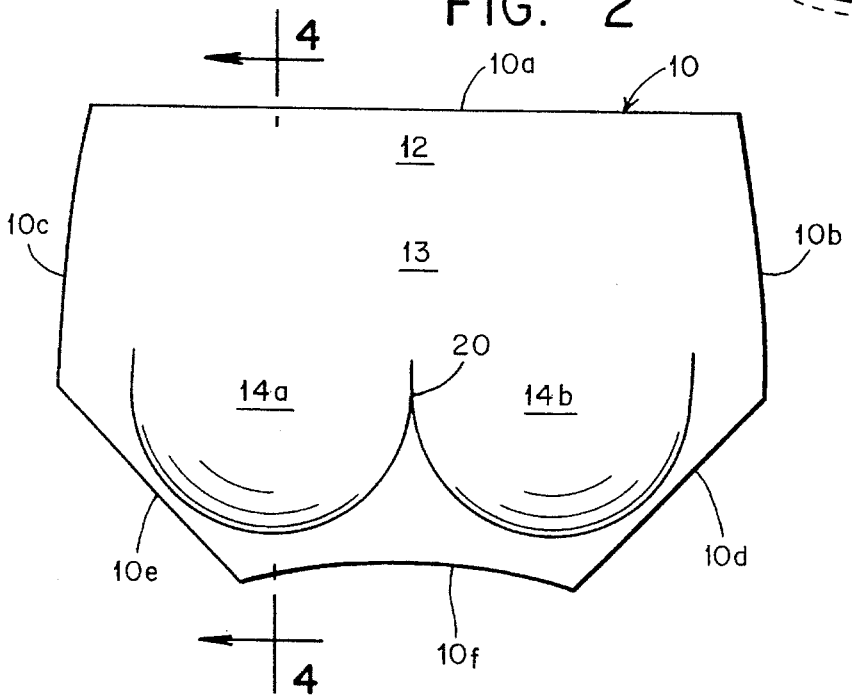
FIG. 2 is a rear side elevational view of the form-shaping pad.
Figure 3:
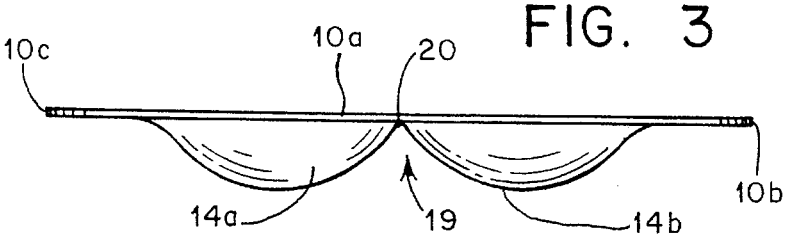
FIG. 3 is a top plan view of the form-shaping pad.

Referring now in detail to the drawings and in particular FIGS. 1, 2 and 3, there is shown a form-shaping pad 10, which is made from a soft flexible material. Pad 10 has six sides designated as upper edge 10*a*, right side margin 10*b*, left side margin 10*c*, right lower margin 10*d*, left lower margin 10*e* and lower edge 10*f*. The rear or exterior side of the pad includes an outwardly protruding pair of curvaceous lower regions or hemispherical lower regions 14*a* and 14*b*. A flat regions 12 extends generally around the periphery of the exterior side of pad 10. Portions of flat region 12 are located at the periphery between left hemispherical region 14*a* and left lower margin 10*e* and the left portion of lower edge 10*f*. Similarly, a part of flat region 12 extends between right hemispherical lower region 14*b* and the right lower margin 10*d* and the right portion of lower edge 10*f*.

Figure 4:
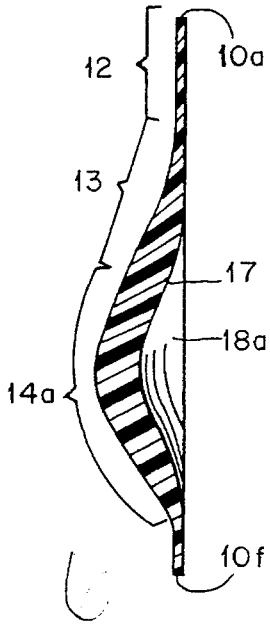
FIG. 4 is a cross-sectional view of the form-shaping pad, taken along the line 4—4 from FIG. 2.

As can be seen in FIG. 4, flat region 12 has a first uniform thickness 16 and hemispherical lower regions 14*a* and 14*b* have a second thickness 17, approximately three to four times larger than the first thickness. A transition region 13 is provided between flat regions 12 and hemispherical regions 14*a* and 14*b*, where the thickness varies between the first thickness 16 and the second thickness 17. Left hemispherical region 14*a* has a corresponding depression 18*a* on the interior or front side of the pad, for accommodating the wearer's buttocks. As can be seen in FIGS. 2 and 3, between hemispherical lower regions 14*a* and 14*b*, is a V-shaped space 19 and a central strip 20 bordering V-shaped space 19. Central strip 20 has a thickness slightly greater than thickness 16.

Figure 5:
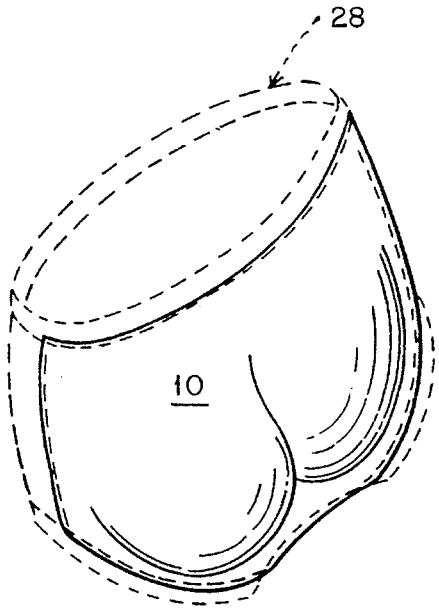
FIG. 5 is a rear, top, left side perspective view of the form-shaping pad incorporated into an undergarment.
Figure 6:
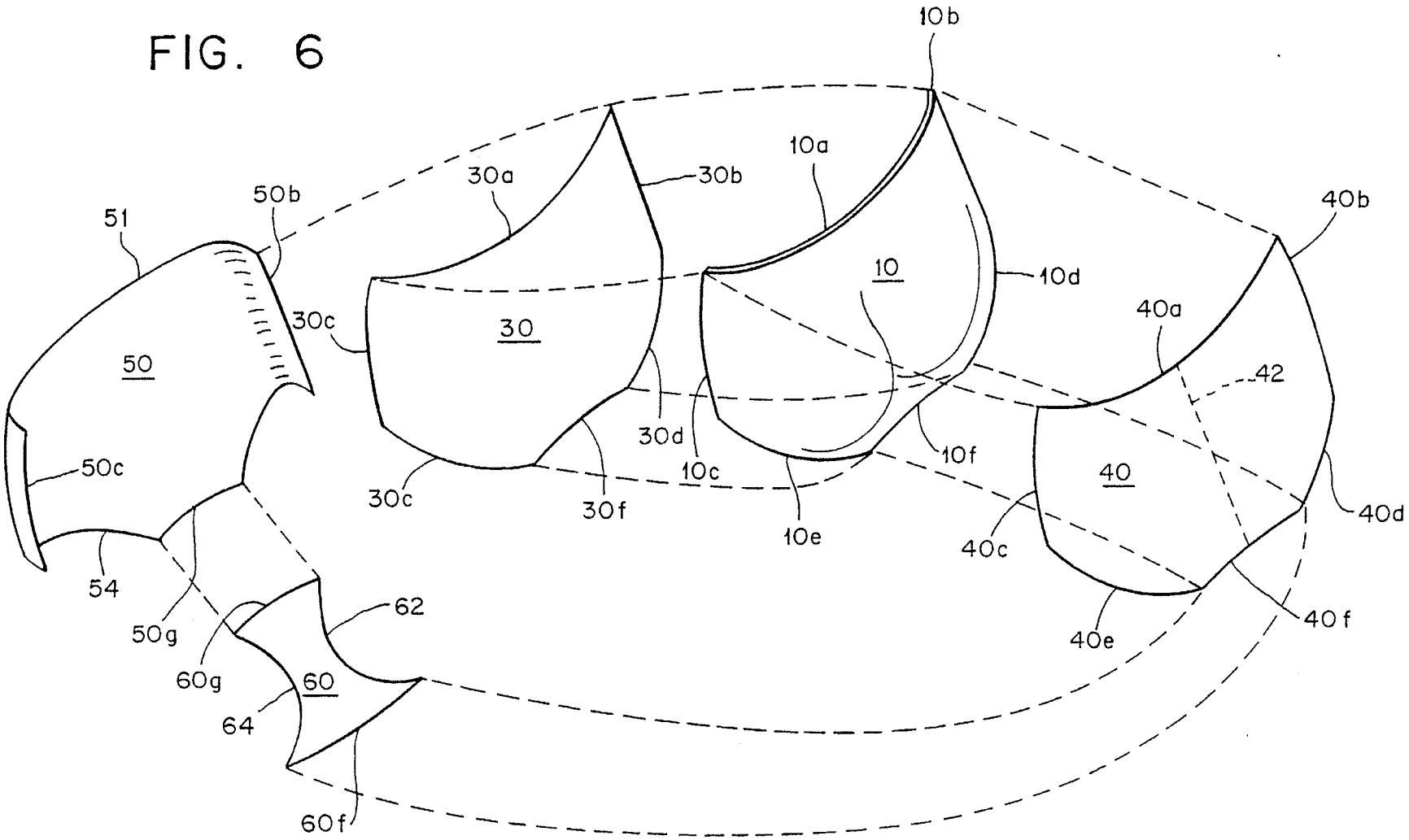
FIG. 6 is an exploded view, showing the pad and various undergarment panels.

FIG. 5 shows pad 10 incorporated into an undergarment 28. The dimensions of pad 10 correspond to the dimensions of the back panel of undergarment 28. The back panel or back portion of undergarment 28, actually consists of an interior back section 30 and an exterior back section 40, which can be seen in FIG. 6. Pad 10, interior section 30 and exterior section 40, all have the same general, peripheral configuration. Pad 10, interior section 30 and exterior section 40 are all sewn together about their matching peripheries. FIG. 6 also shows a front panel or a front portion 50, having two spaced opposite side margins, i.e. right side margin 50*b* and left side margin 50*c*. Front portion 50 also includes an upper edge 51, a right lower margin 52, a left lower margin 54 and a lower edge 50*g*.

A crotch section 60 includes a front edge 60*g*, a rear edge 60*f*, a right edge 62 and a left edge 64. Interior back section 30 includes an upper edge 30*a*, a right side margin 30*b*, a left side margin 30*c*, a right lower margin 30*d*, a left lower margin 30*e* and a lower edge 30*f*. Exterior back section 40 similarly includes an upper edge 40*a*, a right side margin 40*b*, a left side margin 40*c*, a right lower margin 40*d*, a left lower margin 40*e* and a lower edge 40*f*. The letter designations indicate groups of edges or margins, which are stitched or sewn together at a seam. For example, all reference numerals having a "b" designation, like 50*b*, 30*b*, 10*b* and 40*b*, are stitched together into a single seam.

Lower edge 50*g* is sewn to front edge 60*g*. The right side margins 50*b*, 30*b*, 10*b* and 40*b* are all sewn together. The left side margins 50*c*, 30*c*, 10*c* and 40*c* are similarly sewn together. Upper edges 30*a*, 10*a* and 40*a* are also sewn together and when joined define a waist opening with upper edge 51. The right lower margins 30*d*, 10*d* and 40*d* are sewn together as are the left lower margins 30*e*, 10*e* and 40*e*. The lower edges 30*f*, 10*f* and 40*f* are sewn together along with rear edge 60*f*. A right leg opening is then formed between right lower margin 52, right edge 62 and the attached right lower margins 30*d*, 10*d* and 40*d*. A left leg opening is formed by left lower margin 54, left edge 64 and the combined lower left margins 30*e*, 10*e* and 40*e*.

As can be appreciated, pad 10 is sandwiched between back portions 30 and 40 and each of its edges, along its entire periphery, is sewn to each of the corresponding edges on back portions 30 and 40. In addition, the side margins on pad 10 are sewn to the side margins on front portion 50. Finally, lower edge 10*f* of pad 10 is additionally sewn to back edge 60*f* of crotch section 60.

Exterior back section 40 may consist of two separate panels which are joined along a contour producing seam 42, that extends between the pair of hemispherical lower regions 14*a* and 14*b*, within the V-shaped space 19. Contour producing seam 42 allows back portion 40 to more closely follow the contour of pad 10, so that gaps and wrinkles do not occur in back portion 40. Since pad 10 is secured along its entire periphery, it is prevented from shifting within the pouch formed between interior back section 30 and exterior back section 40. By virtue of its intimate combination with undergarment 28, pad 10 is prevented from shifting and remains in position firmly against the wearer. This helps to provide the intended illusion of enhancing and providing added contour for the wearer. As can be seen in FIG. 4, depression 18 will be molded to the wearer's buttocks with the exterior, visible surface displaying a more rounded and curvaceous figure.

In addition to enhancing one's appearance, the pad and undergarment according to the invention may also be utilized in other applications. For example, the device may be used for actors and actresses who require a "heavier" look. In addition, the device may also have therapeutic or medical uses for individuals who sit for long periods of time and may suffer from hemorrhoids or other related conditions. The device could be employed following surgery or childbirth to make the patient more comfortable and hence quicken recovery. The device could further provide cushioned support to the pelvic region and protection for the pelvic area.

While only a single embodiment of the present invention has been shown and described, it is to be understood that many changes and modifications may be made thereunto without departing from the spirit and scope of the invention as defined in the appended claims.

What is claimed is:

1. A form-enhancing undergarment comprising:

a front portion having two spaced opposite side margins;

a back portion having two corresponding spaced opposite side margins, said back portion comprising a pair of overlapping back sections forming a pouch therebetween;

said front portion and said back portion each including an upper edge defining a waist opening;

a crotch section joined between said front portion and said back portion a form-shaping pad disposed in said pouch and extending continuously along and secured uninterruptedly at both side margins and said upper edge of said back portion, wherein said form-shaping pad includes:

(a) a periphery and a flat marginal region with a constant first cross-sectional thickness extending completely around said periphery;

(b) a lower edge and a pair of curvaceous lower regions adjacent said lower edge with a second cross-sectional thickness approximately three times said first thickness; and (c) a transition region extending between said flat marginal region and said pair of curvaceous lower regions having a varying cross-sectional thickness.

2. The pad according to claim 1, wherein said front portion, said back portion and said crotch section have complimentary lower margins forming leg apertures;

wherein said form-shaping pad extends along and is secured at said back portion's lower margins.

3. The pad according to claim 2, wherein said back portion includes a lower edge along which it is joined to said crotch section, said form-shaping pad extends along and is secured at the lower edge.

4. The pad according to claim 3, wherein said pair of overlapping back sections include an interior back section and an exterior back section, wherein said exterior back section includes two fabric panels joined by an contour producing seam.

5. The pad according to claim 4, wherein said form-shaping pad includes a flat side region adjacent each of said side margins.

6. The pad according to claim 5, wherein said form-shaping pad includes a flat lower region adjacent each of said lower margins of said back portion.

7. The pad according to claim 6, wherein said curvaceous lower regions are adjacent said lower margins of said back portion near said lower edge.

8. The pad according to claim 7, wherein said form-shaping pad is made of a soft, flexible material.

9. The pad according to claim 8, wherein said material is foam rubber.

* * * * *